US009897425B1

(12) United States Patent
Hooke

(10) Patent No.: US 9,897,425 B1
(45) Date of Patent: Feb. 20, 2018

(54) PAINTED SHEAR LINER/DENSITY GRADIENT LINER

(71) Applicant: The United States of America as Represented by the Secretary of the Army, Washington, DC (US)

(72) Inventor: Ryan Hooke, Bangor, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/236,632

(22) Filed: Aug. 15, 2016

(51) Int. Cl.
*F42B 12/24* (2006.01)
*F42B 12/22* (2006.01)
*F42B 12/20* (2006.01)

(52) U.S. Cl.
CPC ..... *F42B 12/22* (2013.01); *F42B 12/207* (2013.01); *F42B 12/24* (2013.01)

(58) Field of Classification Search
CPC ..... F42B 12/22; F42B 12/207; F42B 12/24; F42B 12/30; F42B 12/32
USPC ..... 102/481, 491–497, 506; 86/53
See application file for complete search history.

(56) References Cited

U.S. PATENT DOCUMENTS 3,799,054 A * 3/1974 LaRocca ..... F42B 12/22 102/491
4,459,915 A * 7/1984 Lynch ..... F42B 12/22 102/374
4,493,264 A * 1/1985 Jameson ..... F42B 12/32 102/476
5,040,464 A * 8/1991 Pearson ..... F42B 12/24 102/493
5,157,225 A * 10/1992 Adams ..... F42B 12/24 102/493
5,337,673 A * 8/1994 Koontz ..... F42B 12/22 102/389
8,061,275 B1 * 11/2011 Gold ..... F42B 12/22 102/493
8,161,884 B1 * 4/2012 Kokodis ..... F42B 12/24 102/476
2002/0129726 A1 * 9/2002 Clark ..... F42B 1/032 102/476
2005/0223930 A1 * 10/2005 Bootes ..... F42B 12/08 102/473
2012/0174811 A1 * 7/2012 Treadway ..... F42D 5/045 102/315
2016/0377398 A1 * 12/2016 Daebelliehn ..... F42B 33/00 29/428

* cited by examiner

*Primary Examiner* — John Cooper
(74) *Attorney, Agent, or Firm* — Michael C. Sachs

(57) ABSTRACT

An explosive warhead includes shear liners to enhance rupturing of the warhead's housing following an initiation of a detonation charge in the warhead. The shear liners are positioned directly upon the warhead housing's inside surface. The shear liners are applied as metallic powder granules embedded in structural patterns, and applied in a liquid form which is allowed to cure before the charge is installed in to the warhead. Rupture patterns of the warhead housing upon detonation, approximately mimic the structural patterns on the said shear liners.

4 Claims, 1 Drawing Sheet

PAINTED SHEAR LINER/DENSITY GRADIENT LINER

U.S. GOVERNMENT INTEREST

The inventions described herein may be made, used, or licensed by or for the U.S. Government for U.S. Government purposes.

FIELD AND BRIEF SUMMARY OF THE INVENTION

The present invention generally relates to the field of ballistics warheads and explosives, and in particular to casings of warheads, explosively formed projectiles, shaped charges, and other munitions. More specifically, the present invention pertains to the controlled fragmentation of the munition casing or warhead body. Warhead fragmentation effectiveness is determined by the number, mass, shape, and velocity of the fragments. By using a controlled fragmentation design, warhead fragmentation could generally be achieved quickly and cost effectively. Conventional designs have used "cutter" liners that form fragments by generating a complex pattern of high-velocity "penetrators" for fragmenting the shell. Although these conventional fragmentation designs have proven to be useful, it would be desirable to present additional functional, cost and safety improvements that minimize the warhead weight, reduce manufacture expenses, and advance current United States Insensitive Munition (IM) requirements. What is therefore proposed is a controlled fragmentation technique through the use of an additively applied shear plane pattern which contains metal granules, applied onto the inside surface of the warhead; then having a central explosive charge for the warhead poured in completely after the pattern has stabilized and adhered to the warhead case. This metallic composite pattern can be applied via a paint carrier, another binder or carrier vehicle, with an additive machine such as an ink jet printer or welder or by any means which can apply a controlled pattern of a fluidized material which solidifies. When the cured main charge is initiated during use, explosion of the warhead case through these shear plane patterns on the inside surface will introduce shear stresses into the warhead body and create a desired fragmentation pattern and controlled fragment mass distribution. As mentioned, the patterns are applied directly to the interior surface of the fragmentation warhead. It is possible to influence fragment size, fragment quantities, and patterns thereof through choice of the shear plane patterns to be applied.

According to the present invention, warhead fragmentation is believed to be achieved more efficiently and more cost effectively than conventional techniques. In the present invention, the shear plane patterns generate contours of localized transitional regions with high-gradients of pressures, velocities, strains, and strain-rates acting as stress and strain concentration factors. Unstable shear eventually transfers the entire burden of localized strain to a finite number of shear planes leading to the shell break-up and formation of fragments. As a result, the explosion produces a complex pattern of shear planes in the warhead body, causing the case break-up and formation of fragments with predetermined sizes. This design is distinguishable from existing fragmentation liner technologies that attempt to score or cut the warhead body. One of the advantages of the present embodiment compared to existing technologies is the cost effectiveness of the manufacturing process of the present design, in that it is faster and more economical to apply a shear plane pattern to the inside of a warhead, as opposed to notching or cutting a steel warhead body itself. Another advantage of the present invention is that use of resin material to hold the metallic particles when they were applied coincidentally to warhead case can also be an excellent safety feature. An unwanted ignition of the central explosive due to the heat of launch would normally be catastrophic as well as fratricidal. But here, in the event of unwanted heat/ignition the resin (which is a low melt temperature material) would melt to seal the explosive, and, the melted resin would also flow. The melted resin could then push out overflow openings that are usually provided in these rounds. The additional volumetric change and energy consumption of transitioning from a solid to a liquid can reduce the buildup of pressure inside the case, delaying or preventing the detonation of the explosive. Because of the melt able resin, neither sudden pressure nor heat/ignition inside the round would therefore be as catastrophic. Therefore, choice of low-melt temperature resin in this invention, ends up coincidentally to also add safety to the round. This benefit is favorable, consistent with current Insensitive Munition (IM) requirements in minimizing accidental ammunition explosion due to fire hazards.

OBJECTS OF THE INVENTION

Accordingly, it is an object of the present invention to provide an explosive warhead which includes shear liners to enhance rupturing of the warhead's housing following an initiation of a detonation charge in the warhead.

Another object of the present invention is to provide rupture patterns in a warhead housing upon detonation which approximately mimic structural patterns on shear liners which are included in the warhead.

Another object of the present invention is to control the fragmentation mass distribution, size and quantity upon detonation which optimizes the lethality of the warhead.

It is a further object of the present invention to provide an explosive warhead which includes shear liner induction sites which are positioned directly upon the warhead housing's inside surface.

It is yet another object of the present invention to provide an explosive warhead which includes shear liners that are applied as metallic powder granules embedded in structural patterns, the pattern structures being applied in a liquid form which is allowed to cure before the warhead's detonation charge is installed by being poured in to the warhead.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
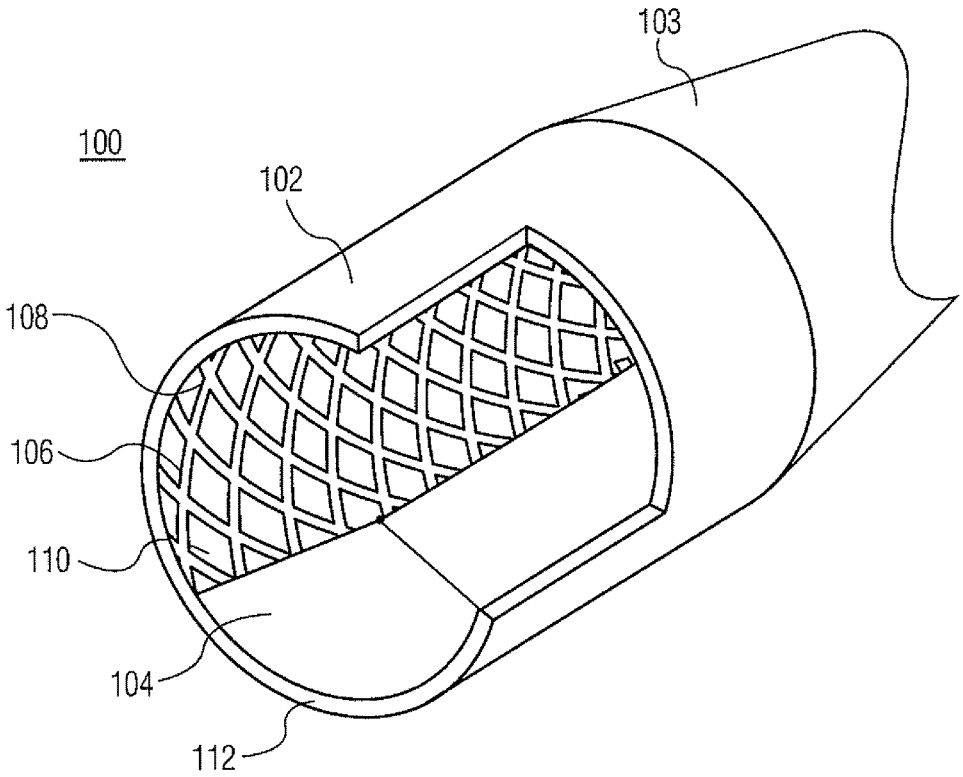
FIG. 1 shows a cutaway view of a projectile with a fragmenting warhead, having shear patterns applied/painted on the inside surface of the warhead, according to this invention.
Figure 2:
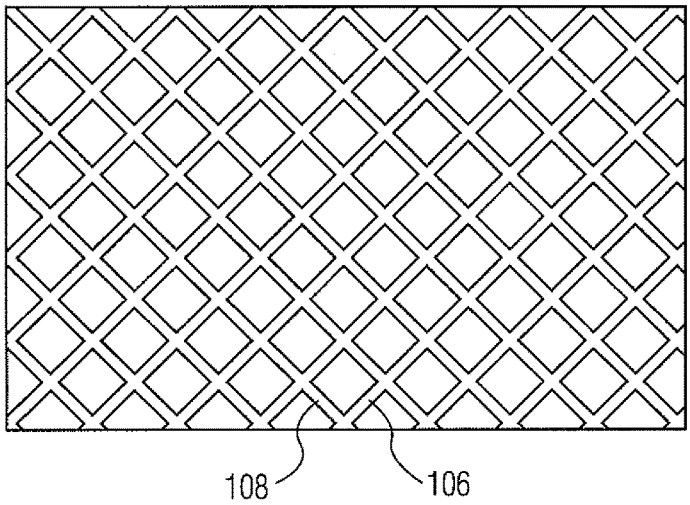
FIG. 2 illustrates a partial view of a shear pattern such as are painted on the inside surface of the warhead, according to this invention.

FIG. 1 shows an explosive warhead 100 which is generally, hollow cylindrically formed. It has a frontal area 103 which may be ogival. It has an outer surface 102 and a rear circularly shaped edge 112 which is usually closed with an end plate (not shown). It has an inner surface 110 upon which are painted metallic powder granules in intersecting multiple parallel diagonal lines 106 and 108, e.g., which may cover the entire inner surface 110. An example of such patterns can be seen in FIG. 2. Lines 108 slope down to the right and lines 106 slope down to the left, generally speaking. The metallic powder granules may be applied in a liquid mix form containing resins, e.g., which are then allowed to dry. The structural patterns of applied (dried) metallic granules may function as shear liner(s) to assist in the explosion of the warhead, as explained elsewhere herein. After the structural patterns have cured, a central charge 104 (only parts of it illustrated) may be poured in to fill the entire warhead's internal cavity. The painted on patterns of metallic granules here will serve as shear liners to enhance rupturing of said warhead housing following an initiation of the charge. These shear liners as seen, are positioned directly upon the warhead housing's inside surface. When the central charge is initiated (by means not fully shown here) rupture patterns of the warhead housing upon exploding, approximately mimic the structural patterns on the shear liners. The metallic powder granules used here may be of tungsten, copper, nickel, steel, stainless steel, ceramic, carbide powders, or other types of metallic granules. In one test, metallic powder of 92.5% pure tungsten was used. The diameter size of the metallic powder granules may be approximately 1 nanometer to 200 microns. In one test tungsten powder of mean granule size about 60 microns was used. As mentioned the metallic powder granules may be applied to the inside surface of the warhead within a liquid mixed form. The mixed form may include substances such as resins, room temperature vulcanization RTV materials, thermoplastic materials, or other materials. In certain tests done, RTV silicone Loctite (Grainger product number 3KMY7), siliconized acrylic caulk (GE 3KA70), and polyurethane sealant (3M 4YDF7) contact cement were considered for use in the liquid mixed form. The ratio by weight of metallic powder granules to the liquid mixed form may be 15 g of metallic powder granules to 5 g of the liquid mixed form, or some other ratio. The metallic powder application may be accomplished by painting the liquid mixed form using a 3D printer machine, through a silk screen printing process, by manual painting, or through some other means. The structural patterns on the shear liners may include diagonal line patterns, or some other patterns or sizes. In cases where resin is used in the liquid mixed form, the warhead may present insensitive munition (IM) venting qualities during an unintended heat event, so as to prevent fratricide of nearby other warheads. This can be the case since the resin may melt during the unintended heat event, and such melted resin allows additional volume into which the initiation charge may burn, rather than explode, within the confinement of the given warhead volume. Additionally, the painted metallic granules may be used to encase electrical leads or other features on the case wall in order to provide electronic or electromagnetic radiation shielding.

While the invention may have been described with reference to certain embodiments, numerous changes, alterations and modifications to the described embodiments are possible without departing from the spirit and scope of the invention as defined in the appended claims, and equivalents thereof.

What is claimed is:

1. An explosive warhead having an outer cylindrically shaped warhead housing having an inner surface thereof, which warhead also comprises a centrally located initiation charge, said warhead including shear liners to enhance rupturing of said warhead housing following an initiation of the charge, wherein the shear liners are positioned directly upon the warhead housing's inside surface, wherein said shear liners are applied as metallic powder granules embedded in structural patterns, and wherein rupture patterns of the warhead housing upon exploding approximately mimic the structural patterns on the said shear liners, and wherein the warhead exhibits insensitive munition (IM) venting qualities when resin in the liquid mixed form melts during an unintended heat event, such melted resin allowing additional volume into which the initiation charge may burn, rather than explode, in confinement.

2. The explosive warhead of claim 1 wherein the shear liner provides electromagnetic shielding in combination with the controlling fragmentation size creation.

3. An explosive warhead having an outer cylindrically shaped warhead housing having an inner surface thereof, which warhead also comprises a centrally located initiation charge, said warhead including shear liners to enhance rupturing of said warhead housing following an initiation of the charge, wherein the shear liners are positioned directly upon the warhead housing's inside surface, wherein said shear liners are applied as metallic powder granules embedded in structural patterns, and wherein rupture patterns of the warhead housing upon exploding approximately mimic the structural patterns on the said shear liners, and wherein the warhead exhibits insensitive munition (IM) venting qualities when eutectic in the liquid mixed form melts during an unintended heat event, such melted resin allowing additional volume into which the initiation charge may burn, rather than explode, in confinement.

4. The explosive warhead of claim 3, wherein the shear liner provides electromagnetic shielding in combination with the controlling fragmentation size creation.

* * * * *